US008776518B1

(12) United States Patent
Das

(10) Patent No.: US 8,776,518 B1
(45) Date of Patent: Jul. 15, 2014

(54) METHOD FOR THE ELIMINATION OF THE ATMOSPHERIC RELEASE OF CARBON DIOXIDE AND CAPTURE OF NITROGEN FROM THE PRODUCTION OF ELECTRICITY BY IN SITU COMBUSTION OF FOSSIL FUELS

(75) Inventor: Subodh Das, Lexington, KY (US)

(73) Assignee: Underground Recovery, LLC, Lexington, KY (US)

( * ) Notice: Subject to any disclaimer, the term of this patent is extended or adjusted under 35 U.S.C. 154(b) by 342 days.

(21) Appl. No.: 13/273,233

(22) Filed: Oct. 14, 2011

Related U.S. Application Data

(60) Provisional application No. 61/422,132, filed on Dec. 11, 2010.

(51) Int. Cl.
*F03G 7/00* (2006.01)

(52) U.S. Cl.
USPC ..... 60/641.2

(58) Field of Classification Search
USPC ..... 60/641.2–641.4
See application file for complete search history.

(56) References Cited

U.S. PATENT DOCUMENTS 4,537,252 A 8/1985 Puri et al.
4,776,638 A 10/1988 Hahn et al.
6,141,950 A * 11/2000 Smith et al. ..... 60/783
6,736,215 B2 5/2004 Maher et al.
6,763,886 B2 7/2004 Schoeling et al.
7,073,578 B2 7/2006 Vinegar et al.
7,077,198 B2 7/2006 Vinegar et al.
7,096,941 B2 8/2006 de Rouffignac et al.
7,096,953 B2 8/2006 de Rouffignac et al.
7,114,566 B2 10/2006 Vinegar et al.
7,121,342 B2 10/2006 Vinegar et al.
7,360,588 B2 4/2008 Vinegar et al.
7,640,980 B2 1/2010 Vinegar et al.
7,798,221 B2 9/2010 Vinegar et al.
7,866,386 B2 1/2011 Beer et al.
7,909,093 B2 3/2011 Brown et al.
7,912,358 B2 3/2011 Stone, Jr. et al.
7,942,203 B2 5/2011 Vinegar et al.
7,950,453 B2 5/2011 Farmayan et al.
8,027,571 B2 9/2011 Vinegar et al.
2009/0020456 A1 * 1/2009 Tsangaris et al. ..... 208/133
2009/0266540 A1 * 10/2009 De Francesco ..... 166/261
2012/0005959 A1 * 1/2012 Chen et al. ..... 48/61
2012/0056431 A1 * 3/2012 Bland et al. ..... 290/52

* cited by examiner

*Primary Examiner* — Hoang Nguyen
(74) *Attorney, Agent, or Firm* — Francis Law Office PLLC; James M. Francis

(57) ABSTRACT

The in situ combustion of subterranean fossil fuels, e.g. coal, oil, and methane, and subsequent separation of combustion gases from nitrogen provides a method to minimize environmental pollution from combustion by-products through subterranean sequestration of carbon while using captured nitrogen as a heat transfer media vented to the surface and used for the production of electricity in mobile turbines for transfer to population centers or for use in energy banks such as the production of goods by electricity intensive manufacturing processes.

6 Claims, 1 Drawing Sheet

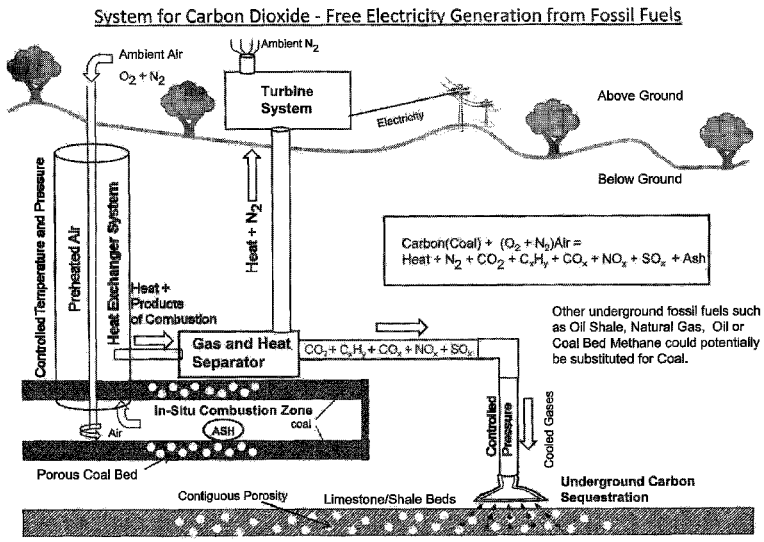

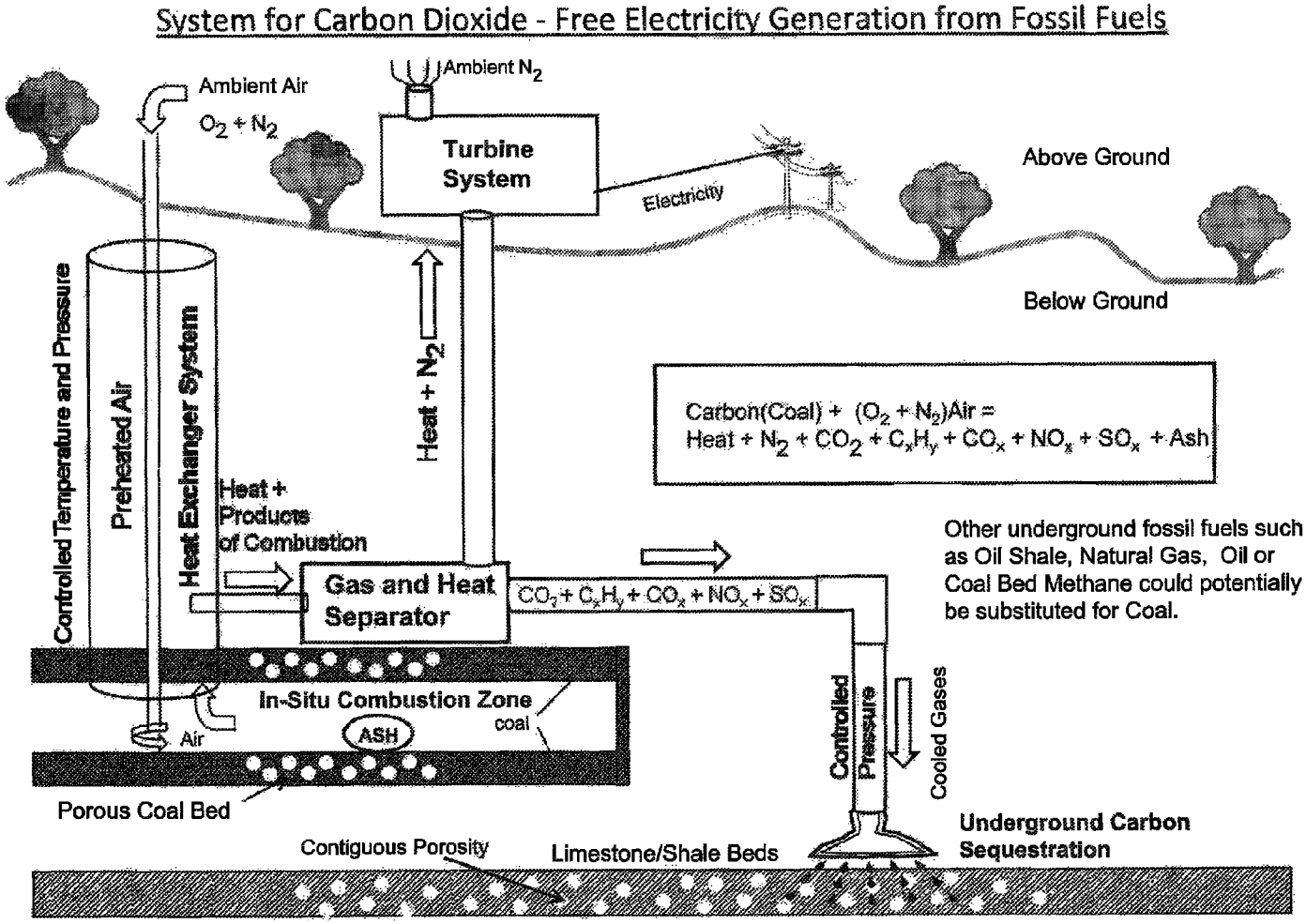
System for Carbon Dioxide - Free Electricity Generation from Fossil Fuels
Above Ground
Below Ground
Electricity
Ambient N2
Turbine System
Ambient Air
O2 + N2
Heat + N2
Carbon(Coal) + (O2 + N2)Air =
Heat + N2 + CO2 + CxHy + COx + NOx + SOx + Ash
Other underground fossil fuels such as Oil Shale, Natural Gas, Oil or Coal Bed Methane could potentially be substituted for Coal.
Gas and Heat Separator
CO2 + CxHy + COx + NOx + SOx
Controlled Pressure
Cooled Gases
Underground Carbon Sequestration
Heat + Products of Combustion
Heat Exchanger System
Preheated Air
Controlled Temperature and Pressure
In-Situ Combustion Zone
coal
ASH
Air
Porous Coal Bed
Contiguous Porosity
Limestone/Shale Beds

METHOD FOR THE ELIMINATION OF THE ATMOSPHERIC RELEASE OF CARBON DIOXIDE AND CAPTURE OF NITROGEN FROM THE PRODUCTION OF ELECTRICITY BY IN SITU COMBUSTION OF FOSSIL FUELS

CROSS REFERENCE TO RELATED APPLICATIONS

This application claims the benefit of U.S. Provisional Patent Application Ser. No. 61/422,132, entitled "SYSTEM FOR THE ELIMINATION OF THE ATMOSPHERIC RELEASE OF CARBON DIOXIDE AND THE CAPTURE OF NITROGEN FROM THE IN SITU COMBUSTION OF FOSSIL FUELS FOR THE PRODUCTION OF ELECTRICITY" filed Dec. 11, 2010.

FIELD

This invention generally relates to methods to control pollution created during the generation of electricity from fossil fuels.

BACKGROUND

Worldwide coal reserves are vast, over 10 trillion metric tons, but unless cleaner and cheaper ways can be found to combust coal with air into useful heat, which subsequently can be harnessed into energy and electricity using boiler/turbines systems, coal is unlikely to become an acceptable replacement for dwindling and uncertain supplies of oil and natural gas since the combustion of coal generates unwanted carbon dioxide and other undesirable products of combustion.

Atmospheric release of unwanted carbon dioxide which is a potent greenhouse gas causes negative climate changes and global warming. The collection and cleaning of this vast amount of carbon dioxide prior to atmospheric release is expensive and energy intensive. Piping of the carbon dioxide for sequestration either above ground (either for chemical production or agricultural uses) or underground is legally and economically cumbersome and uses unproven technology with unknown side implications. In addition to carbon dioxide, the combustion of coal, also produces ash (complex oxides with many unwanted and harmful elements such as arsenic and mercury contained in the coal) which causes land, water and air pollution. Furthermore, mining coal is dangerous work, coal is dirty to burn, and much of the coal in the ground is too deep or too low in quality to be mined economically or not economically feasible to extract because the seams are too "thin". Today, less than one-sixth of the world's coal is economically and technologically accessible.

SUMMARY

The present disclosure addresses the use of subterranean heat sources, such as the in situ combustion of coal and trapped hydrocarbons, such as coal bed methane, as a way to minimize pollution from combustion by-products, e.g. carbon dioxide, carbon monoxide, $NO_x$, $SO_x$, and ash. In situ coal combustion facilitates carbon dioxide capture and sequestration and eliminates the costly disposal of ash. The above ground combustion of coal, petroleum, and petroleum derivatives, e.g. gasoline, produces flue gases and solids which become a source of pollution and present health hazards from the release of many carcinogens and greenhouse gases such as carbon dioxide adding their contribution to global warming. In situ combustion at the source of the fossil fuel prevents release of combustion by-products, i.e. pollution, into man's habitable environment.

Separation and recovery of the hot $N_2$ gas resulting from combustion permits the recovery of a valuable product and use of the transferred heat to drive the generation of electricity above ground. The separated CO and $CO_2$ are sequestered underground so that carbon is not introduced into the environment. The separated and recovered $CO_2$ is useful for diversion to nearby methane deposits frequently found near coal for the purpose of displacing methane with heavier $CO_2$, potentially delivered by horizontal drilling, and recovering the displaced methane through the drilling of wells. This method is also useful to extract additional methane from abandoned wells that were believed to be unable to produce additional methane.

BRIEF DESCRIPTION OF THE DRAWINGS

FIG. 1 depicts a flow chart of the method as used in subterranean strata.

DETAILED DESCRIPTION OF THE PREFERRED EMBODIMENTS

As depicted in FIG. 1, one such underground coal combustion process involves feeding preheated air, heated from the upwelling of hot combustion byproduct gases using heat exchangers, to a coal seam for the purpose of supporting combustion. This involves the injection of oxygen as either ambient air, pure oxygen, or an oxygen enriched stream of ambient air or other gases into one location of an underground mine with remaining coal reserves while hot gases such as flue gas escape through a distant end. Deep mines which are not economically viable to mine and mines which have had most of the recoverable coal removed present excellent opportunities for underground coal combustion.

In one embodiment, the elimination of nitrogen at the point of combustion simplifies the separation of nitrogen from carbon dioxide following combustion. The oxygen containing gas stream is piped through a conduit to a high wall, auger, or deep mine cavity. The conduit could be constructed so as to provide a supply of fresh ambient air throughout the length of the cavity or mine. Alternatively, the supply of fresh air could be progressively repositioned as the combustion zone moves.

The exits of the cavity chosen for combustion are sealed and the heated gases are extracted, separated, and their heat used in a controlled manner for subsequent use in a steam turbine above ground. Spontaneous combustion of in situ coal is known to occur at temperatures as low as 30° C. to 40° C. due to an exothermic chemical reaction that occurs in the presence of oxygen. A selected volume of heated gaseous combustion by-products could be utilized in a heat exchanger or series of heat exchangers to heat the ambient air prior to injection.

The hot carbon dioxide and other products of combustion gases such as carbon monoxide, hydrocarbons and complex oxides of sulfur are separated from the hot nitrogen through a process of at least one gas separation and at least one heat exchange process. As depicted in FIG. 1, the cooled carbon dioxide and all other products of combustion, (except nitrogen) is returned at predetermined controlled pressures and temperatures to the strata for sequestration in the pores of limestone shale beds or other rocks of contiguous but sealed porosity usually found underneath the coal beds. Current regulations prohibit the construction of above ground or below ground pipelines that would be necessary for the transport of carbon dioxide to remote gas wells. On site or local production of carbon dioxide from underground coal conversion is a cost effective solution to the carbon dioxide transportation problem.

The hot nitrogen is directed to the above ground steam turbine system to heat water or other materials which can enter their gas phase at the system temperature employed to make a gas which is used to drive the turbine in an effort to produce electricity. The cooled and uncontaminated nitrogen gas can then be collected for chemical production or agricultural applications or vented to the atmosphere. The separation process minimizes the loss of heat from the separated $N_2$ to ensure that the separated $N_2$ possesses enough thermal energy to generate a sufficient amount of steam from water so as to drive the steam turbine. Alternatively, the separated $N_2$ can be redirected past or through the combustion zone for heating to act as a gaseous heat transfer media. The separation process preferably utilizes multiple stages.

Appropriate geology of upper coal bed and underneath limestone is required to avoid contamination of the local water table and to avoid subsidence. Subsidence avoidance technology can also be employed, e.g. the backfilling of voids. Appropriate geology also opens up additional possibilities for carbon sequestration by utilizing separated $CO_2$ to displace methane pockets associated with shale formations. Piping of $CO_2$ separated from combustion gases to shale formations permits the heavier $CO_2$ to dislodge the lighter, and more valuable, $CH_4$ that often accompanies coal formations. Gas wells abandoned because of faltering production because of the successful extraction of larger pockets of $CH_4$ can produce additional natural gas when the smaller pockets trapped beneath shale or other rock formations is displaced and driven toward an existing or new well. It is also useful to inject the separated and recovered $CO_2$ to cause horizontal fracturing, or fracking, of the strata to facilitate the accumulation and extraction of residual pockets of natural gas.

Other potential heat removal methods could involve the use of a heat transfer fluid, e.g. a molten salt, or a heat transfer material, e.g. carbon foam, to extract heat from the zone of combustion more efficiently. A molten salt could be pumped through an insulated conduit to a distal heat exchanger. Also, a solid carbon foam heat conductor could be insulated except for its distal end and proximal end so as to minimize heat loss and improve thermal conductance from the heat source to a point where the heat can be captured.

The use of heat transfer fluids or carbon foam can also be utilized with other subterranean heat sources as well such as methane, petroleum and even lava. Alternatively, the technology can be used to inject air or an oxygen mix into a coal seam, which undergoes a controlled burn to produce and then pipe to the surface hot nitrogen. The combustible gas can then be utilized with a turbine to generate electricity.

Ideally, the turbine system (preferably placed above surface), gas and heat separator system (can be placed either above or underground) could be modular and mobile or movable as the point of coal combustion location moves to take advantage of fresh uncombusted coal seams. Old mines typically have numerous ventilation shafts which can be utilized for the movement of gases. Old gas wells can typically be utilized with a minimal amount of angular drilling for $CO_2$ delivery to the shale to displace small, trapped pockets of methane.

The mobility of the turbine system permits the generation of electricity in inhospitable and remote locations. Movement of large quantities of extracted hydrocarbons is costly and bears risk to the environment. Transmission of electricity created from combusted hydrocarbons is more efficient and safer, however transmission lines are not always available in remote locations and their installation is often costly and difficult in remote locations with difficult topography. Storage of electricity in energy cells is one option for the transportation of remotely produced energy. Alternatively, energy banks can be utilized which permit the creation and transportation of products which require a considerable amount of electrical energy, e.g. the creation of products which require a considerable amount of electricity such as the production of aluminum or fertilizer.

The remote manufacture and subsequent transfer of products which are produced by energy intensive processes relocates the burden of electricity production away from population centers and existing power plants. The erection of transmission lines to form a power collection grid permits the extension of the useful range of the system.

What is claimed is:

1. A method of producing electricity comprising the in situ combustion of fossil fuels, the subterranean separation and recovery of $N_2$ from combustion gases, wherein said $N_2$ transfers heat from said in situ combustion of fossil fuels to water used in a steam turbine which generates electricity.

2. The method of claim 1, wherein carbon containing combustion gases are separated in a subterranean process and sequestered in subterranean strata.

3. The method of claim 2, wherein $CO_2$ separated in a subterranean process is utilized to displace methane pockets trapped within the strata.

4. The method of claim 3, wherein said methane is recovered through a well.

5. The method of claim 1, wherein said steam turbine is mobile.

6. The method of claim 5, wherein said electricity generated by said steam turbine is used in an energy intensive process to produce a product for shipment from a remote location.

* * * * *